US009661941B1

(12) United States Patent
Sawyer et al.

(10) Patent No.: US 9,661,941 B1
(45) Date of Patent: May 30, 2017

(54) HEADBOARD DISPLAY RACK

(71) Applicant: England, Inc., Monroe, MI (US)

(72) Inventors: Otis Sawyer, Morristown, TN (US); Gene Brock, New Tazewell, TN (US)

(73) Assignee: England, Inc., Monroe, MI (US)

( * ) Notice: Subject to any disclaimer, the term of this patent is extended or adjusted under 35 U.S.C. 154(b) by 0 days.

(21) Appl. No.: 15/222,130

(22) Filed: Jul. 28, 2016

(51) Int. Cl.
*A47F 7/30* (2006.01)
*A47F 5/00* (2006.01)
*A47F 5/10* (2006.01)

(52) U.S. Cl.
CPC ..... *A47F 7/30* (2013.01); *A47F 5/0087* (2013.01); *A47F 5/0093* (2013.01); *A47F 5/105* (2013.01)

(58) Field of Classification Search
CPC ..... A47F 7/30; A47F 5/105; A47F 5/0087; A47F 5/0093; A47F 7/00; A47F 7/0042; A47F 7/163; A47F 7/16; A47F 5/137
USPC ..... 211/27
See application file for complete search history.

(56) References Cited

U.S. PATENT DOCUMENTS 1,688,255 A * 10/1928 Wasch ..... A47F 7/0042 211/168
3,394,790 A * 7/1968 Braun ..... A63C 11/007 194/256
3,960,273 A * 6/1976 Weston ..... A47F 7/0246 211/165
5,649,631 A * 7/1997 Loflin ..... A47F 7/175 211/168
6,286,692 B1 * 9/2001 Hemping ..... A47F 7/00 206/325
6,340,092 B1 * 1/2002 McGrath, Jr. ..... A47F 7/0042 211/169
6,547,087 B2 * 4/2003 Accatino ..... A47F 5/132 211/169
7,204,372 B2 * 4/2007 Kin ..... A47F 7/163 211/45
7,481,323 B2 * 1/2009 Fisher ..... B05B 13/0285 211/189
7,624,880 B2 * 12/2009 Kin ..... A47F 5/137 211/45

* cited by examiner

*Primary Examiner* — Korie H Chan
(74) *Attorney, Agent, or Firm* — Harness, Dickey & Pierce, P.L.C.

(57) ABSTRACT

A headboard display rack for displaying a plurality of headboards. The display rack includes a frame, a plurality of bracket assemblies pivotably attached to the frame, and a plurality of roller assemblies that correspond to each of the bracket assemblies, wherein each bracket assembly is configured to support a first end of the headboard, and each roller assembly is configured to support a second end of the headboard.

16 Claims, 6 Drawing Sheets

HEADBOARD DISPLAY RACK

FIELD

The present disclosure relates to a headboard display rack.

BACKGROUND

This section provides background information related to the present disclosure which is not necessarily prior art.

Headboards for beds are bulky items that are generally displayed when in a final configuration. That is, the headboards are generally displayed when attached to a bed frame. This requires a store that sells headboards to have a lot of floor space to display each headboard, which is undesirable. Alternatively, the individual headboards may be leaned against each other in a stack against a wall, which requires the customer to browse through the headboards by pulling the individual headboards out from the stack in order to view them. This is also undesirable because, as noted above, headboards are bulky items that can be heavy and difficult to move. There is a need, therefore, for a manner to display a plurality of headboards in the same location that allows a customer to easily browse the individual headboards by easily moving the headboards relative to one another.

SUMMARY

This section provides a general summary of the disclosure, and is not a comprehensive disclosure of its full scope or all of its features.

The present disclosure provides a headboard display rack for displaying a plurality of headboards. The display rack includes a frame, a plurality of bracket assemblies pivotably attached to the frame, and a plurality of roller assemblies that correspond to each of the bracket assemblies, wherein each bracket assembly is configured to support a first end of the headboard, and each roller assembly is configured to support a second end of the headboard.

The present disclosure also provides a method for displaying a plurality of headboards, which includes attaching a plurality of headboards to a headboard display rack, wherein the step of attaching the plurality of headboards to the headboard display rack includes attaching a first end of the headboard to a bracket assembly that is pivotably attached to a frame by resting the first end on a seat of the bracket assembly, fixing the first end to the seat by fastening the first end to a first lateral support plate that extends from the seat, and securing the first end to the bracket assembly using an upper support member that includes a pair of prongs configured to contact and sandwich the first end therebetween; and attaching a second end of the headboard to a roller assembly that is separate and apart from the frame and bracket assembly by resting the second end on a footing of the roller assembly and fastening the second end to a second lateral support plate that extends from the foot.

Lastly, the present disclosure provides headboard display rack for displaying a plurality of headboards, wherein the headboard display rack includes a frame including an upper tubular member and a lower tubular member connected by a pair of side tubular members; a pair of feet supporting the frame; and a plurality of bracket assemblies pivotably attached to the frame, wherein each of the bracket assemblies includes an elongate support member extending between the upper tubular member and the lower tubular member; a first arm pivotably coupling the elongate support member to the upper tubular member; a second arm pivotably coupling the elongate support member to the lower tubular member, the second arm defining a seat that is configured to support a first end of one of the headboards; a first lateral support plate attached to and extending from the seat, and including an elongate slot for receipt of a fastener that secures the first end to the first lateral support plate; and an upper support member including a base plate pivotably attached to the elongate support member, and including a pair of prongs extending from the base plate. The display rack also includes a plurality of roller assemblies that correspond to each of the plurality of bracket assemblies, each roller assembly including a footing that is configured to support a second end of the one of the headboards with a caster attached thereto, and each roller assembly including a second lateral support plate attached to and extending from the footing, the second lateral support plate including another elongate slot for receipt of another fastener that secures the second end to the second lateral support plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
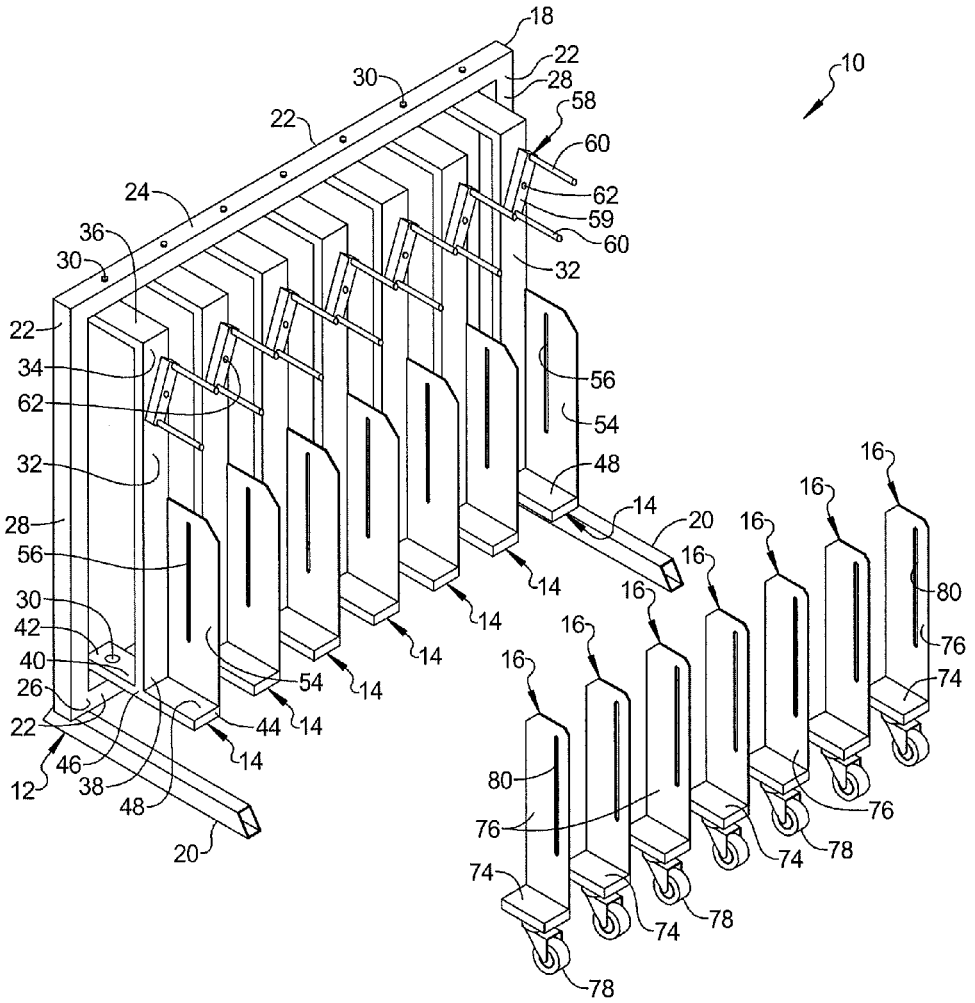
FIG. 1 is a perspective view of a headboard display rack according to a principle of the present disclosure.

Example embodiments will now be described more fully with reference to the accompanying drawings.

FIGS. 1-6 illustrate an example headboard display rack 10 according to a principle of the present disclosure. Headboard display rack 10 includes a bracket assembly 12 including a plurality of brackets 14. In addition, headboard display rack 10 includes a plurality of roller assemblies 16 that correspond to each of the brackets 14.

Bracket assembly 12 includes a frame 18 supported by a pair of feet 20, for supporting the plurality of brackets 14. Frame 18 may be formed from tubular members 22 including an upper tubular member 24, a lower tubular member 26, and a pair of side tubular members 28 that are integrally connected by welding or the like. Although tubular members 22 and feet 20 are illustrated as being rectangular or square, it should be understood that circular tubular members may be used without departing from the scope of the present disclosure. Preferably, tubular members 22 and feet 20 are formed of a rigid material such as steel, aluminum, or some other type of metal material.

Brackets 14 are pivotably supported between upper tubular member 24 and lower tubular member 26 by pins 30 that allow brackets 14 to pivot towards and away from side tubular members 28. Brackets 14 each include a primary elongate support member 32. A first end 34 of elongate support member 32 includes a first or upper arm 36 pivotably attached to upper tubular member 24 of frame 18, and a second end 38 of elongate support member 32 includes a second or lower arm 40 pivotably attached to lower tubular member 26 of frame 18. Elongate support member 32, upper arm 36, and lower arm 40 are plate-shaped members that are integrally connected by welding or the like. Preferably, elongate support arm 32, upper arm 36, and lower arm 40 are formed of a rigid material such as steel, aluminum, or some other type of metal material.

Figure 2:
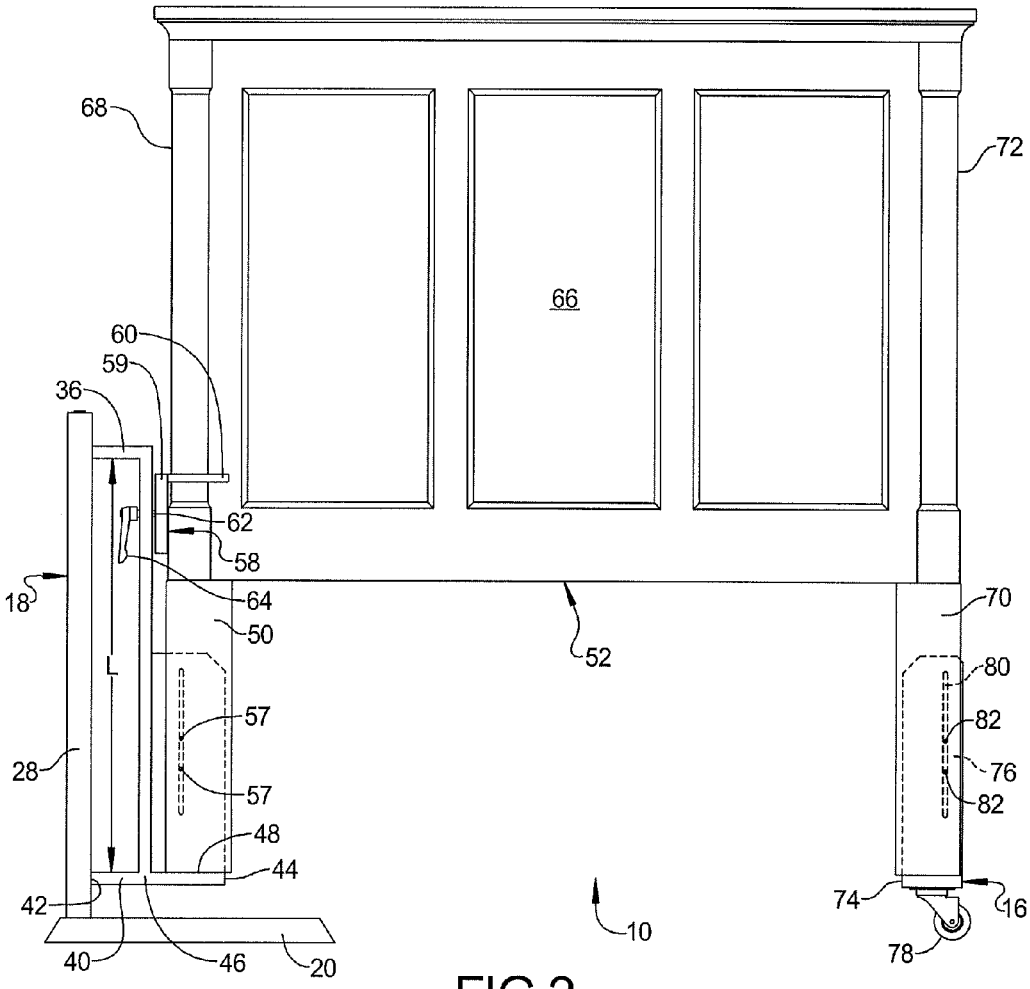
FIG. 2 is a side-perspective view of the headboard display rack illustrated in FIG. 1, supporting an example headboard according to a principle of the present disclosure.
Figure 3:
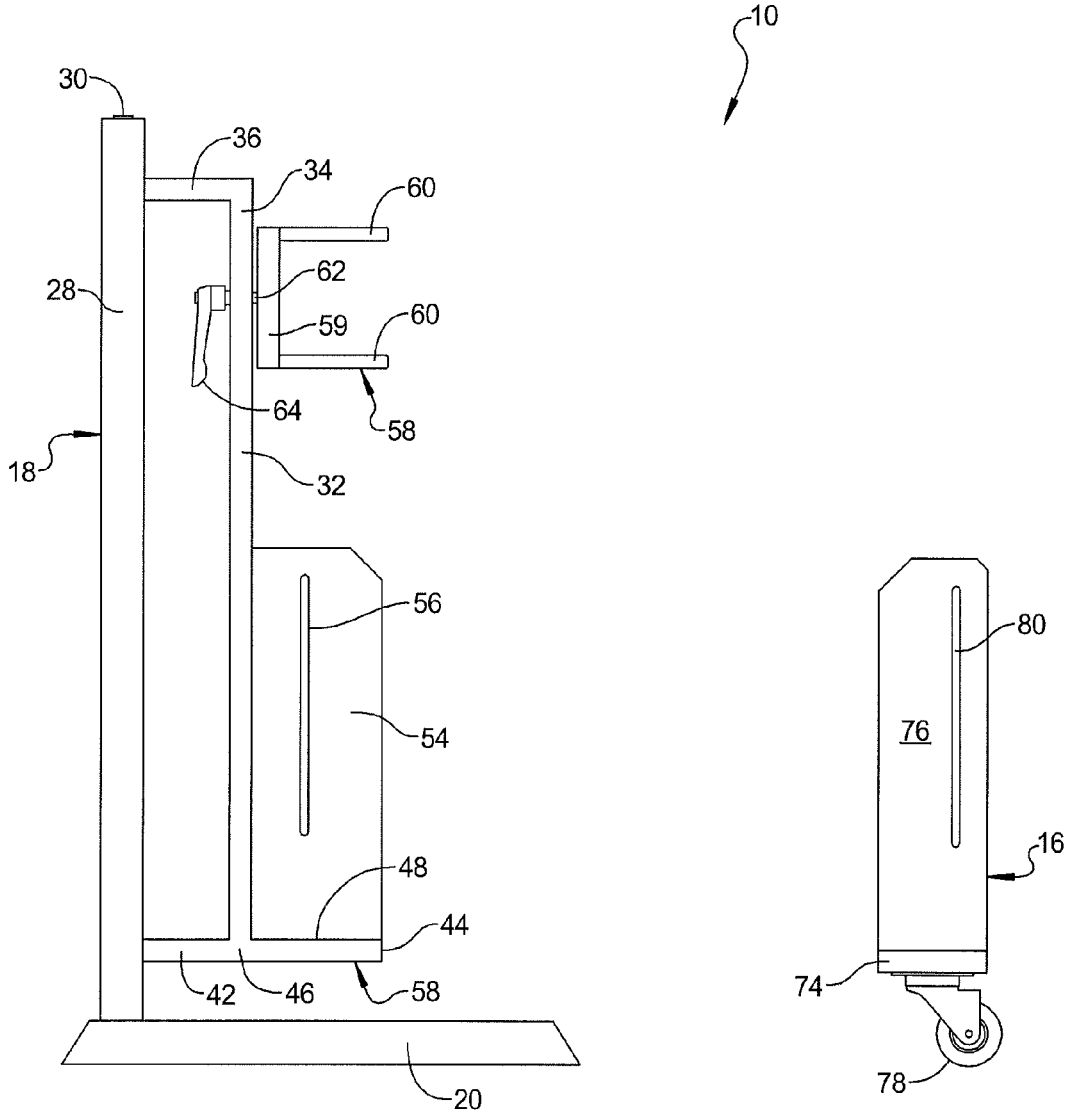
FIG. 3 is a side-perspective view of the headboard display rack illustrated in FIG. 1.
Figure 4:
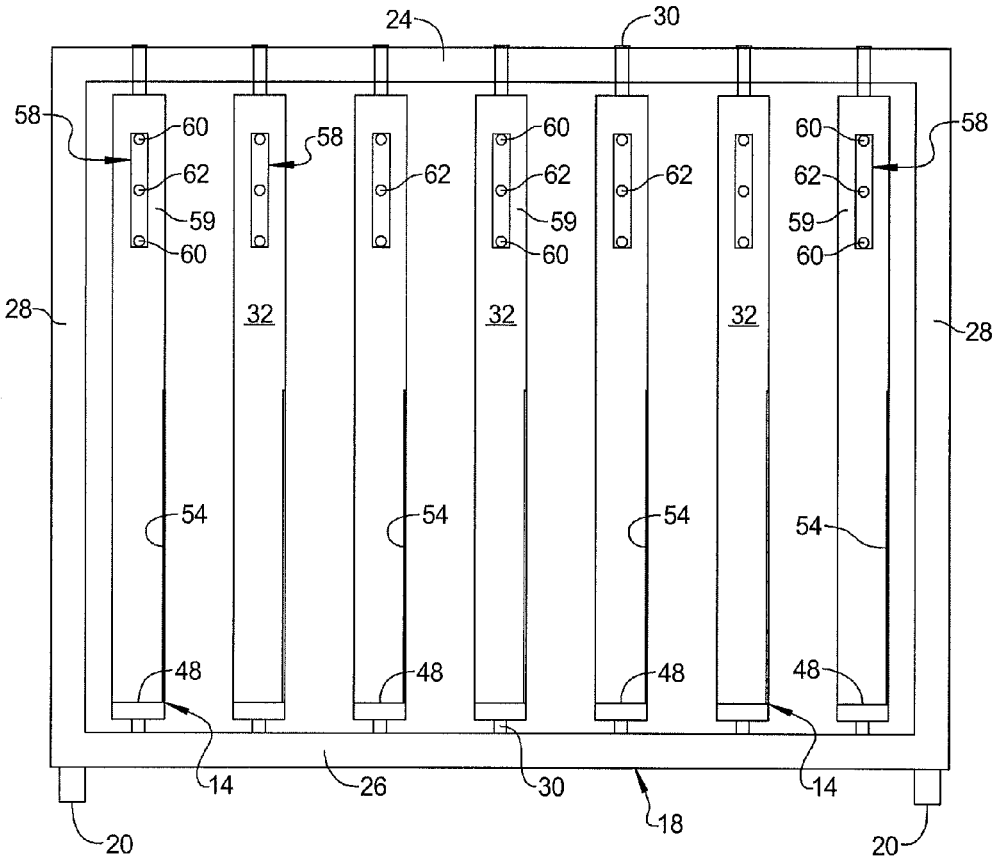
FIG. 4 is a rear-respective view of the headboard display rack illustrated in FIG. 1.
Figure 5:
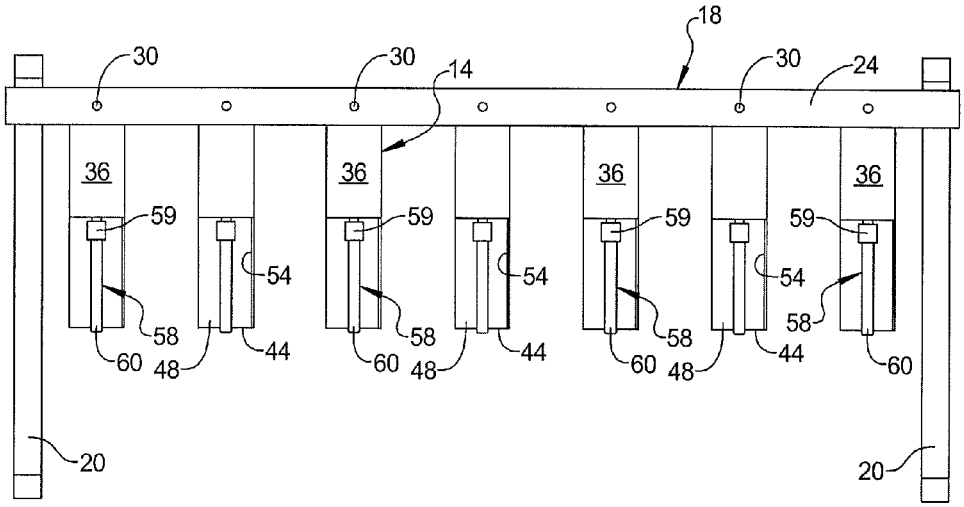
FIG. 5 is a top-perspective view of the headboard display rack illustrated in FIG. 1.
Figure 6:
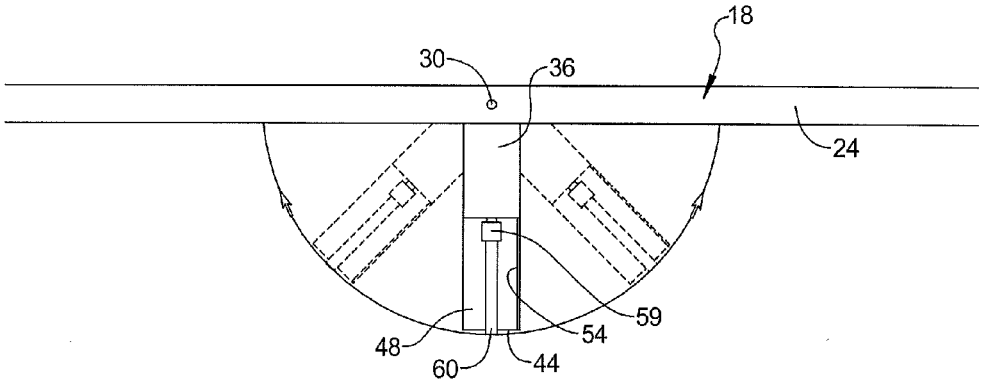
FIG. 6 is a partial top-perspective view of the headboard display rack illustrated in FIG. 1, illustrating a range of motion of bracket assembly that supports a portion of the headboard relative to a frame.

Lower arm 40 includes a proximal end 42 pivotably connected to lower tubular member 26 of frame 18 and a distal end 44. As best shown in FIGS. 1-3, elongate support member 32 is attached to lower arm 40 are about a middle portion 46 of lower arm 40 between proximal end 42 and distal end 44. In this manner, distal end 44 defines a seat 48 for supporting a first leg or portion 50 of a headboard 52 supported by headboard display rack 10 (FIG. 2).

A first lateral support plate 54 including an elongate aperture or slot 56 extends upward from distal end 44, and is integrally connected to distal end 44 and elongate support member 32 by welding or the like. First leg or portion 50 of headboard 52 may be fixed to first lateral support plate 54 using at least one screw 57 or some other type of fastener. First lateral support plate 54 extends along elongate support member 32 about half a length L of elongate support member 54 such that, when first leg or portion 50 of headboard 52 rests on seat 48 and is fixed to first lateral support plate 54 with screws 56, headboard 52 is reliably secured thereto.

To further assist in reliably securing headboard 52 to bracket 14, brackets 14 each include an upper support member 58 attached to elongate support member 32. Upper support member 58 includes a base plate 59 pivotably attached to elongate support member 32. A pair of prongs 60 extend outward from base plate 59. Prongs 60 are spaced apart such that headboard 52 may fit between prongs 60 when headboard 52 is attached to bracket 14. In other words, prongs 60 are spaced apart a distance greater than a width of first leg or portion 50 of headboard 52. Base plate 59 is pivotably attached to elongate support member 32 using a threaded pin 62. Base plate 59 is pivotably attached to elongate support member 32 such that when headboard 52 is fit between prongs 60, base plate 59 may be rotated to contact each prong 60 with headboard 52. Once each prong 60 contacts headboard 52, upper support member 58 may be locked by rotating handle 64 that is engaged with threaded pin 62. Thus, by fixing first leg or portion 50 of headboard 52 to first lateral support plate 52, contacting prongs 60 with headboard 52, and then locking prongs 60 in the contacting position with headboard 52, headboard 52 is reliably secured to bracket 14.

As best shown in FIG. 2, headboard 52 includes first leg or lower portion 50 and a main panel 66. First leg or portion 50 is attached to a first end 68 of main panel 66, and a second leg or portion 70 is attached to a second and opposite end 72 of main panel 66. As noted above, first leg or portion 50 is attached to bracket 14. Roller assemblies 16 are configured to support second leg or portion 70 of headboard 52.

Roller assemblies 16 each include a footing 74 and a second lateral support plate 76. A wheel or caster 78 is attached to each footing 74. When headboard 52 is fixed to each of bracket 14 and roller assembly 16, caster 78 allows headboard 52 to pivot relative to frame 18. Thus, when a plurality of headboards 52 are attached to headboard display rack 10, a customer can inspect each headboard 52 by moving respective headboards 52 towards or away from adjacent headboards 52. Casters 78 may be any type of caster that is known to one skilled in the art so long as casters 78 are able to support the weight of headboard 52. Further, it should also be noted that casters 78 may be fixed to footing 74, or may be removable from footing 74. It should be understood that although roller assemblies 16 are illustrated in FIGS. 1-3 as being separate and apart from bracket assembly 12, roller assemblies 16 may also be integral or unitary with brackets 14. In this regard, lower arm 40 may be extended to be unitary with footing 74 without departing from the scope of the present disclosure.

Second lateral support plate 76 is similar to first lateral support plate 54. In this regard, second lateral support plate 76 also includes an elongate aperture or slot 80 that extends upward from footing 74, and is integrally connected to footing 74 by welding or the like. Second leg or portion 70 of headboard 52 may be fixed to second lateral support plate 76 using at least one screw 82 or some other type of fastener. Second lateral support plate 76 may have a length that is equal to that of first lateral support plate 54 such that, when second leg or portion 70 of headboard 52 rests on footing 74 and is fixed to second lateral support plate 76 with screws 82, headboard 52 is reliably secured thereto.

To secure headboard 52 to headboard display rack 10, a roller assembly 16 may be first attached to second leg or portion 70 of headboard 52. In this regard, second leg or portion 70 is placed on footing 74, and screws 82 are used to secure second leg or portion 70 to second lateral support plate 76. Then, first leg or portion 50 is placed upon seat 48 and between prongs 60 of upper support member 56. Base plate 58 is then pivoted relative to elongate support member 32 to contact prongs 60 with first leg or portion 50 of headboard 52, and handle 64 is rotated to lock upper support member 56 in place. Then, first leg or portion 50 is secured to first lateral support plate 54 using screws 56. Headboard 52, therefore, is reliably supported and attached to frame 18. Once a plurality of headboards 52 are attached in the same manner, a customer is then free to browse through each of the headboards 52 attached to headboard display rack 10 by pivoting the integrated brackets 14, headboards 52, and roller assemblies 16 relative to frame 18.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A headboard display rack for displaying a plurality of headboards, comprising:

a frame;

a plurality of bracket assemblies pivotably attached to the frame; and a plurality of roller assemblies that correspond to each of the bracket assemblies, the plurality of roller assemblies being separate and apart from the frame and the plurality of bracket assemblies, wherein each bracket assembly is configured to support a first end of the headboard, and each roller assembly is configured to support a second end of the headboard.

2. The headboard display rack according to claim 1, wherein each bracket assembly includes an elongate support member, a first arm connected to the elongate support member that is pivotably connected to the frame, and a second arm connected to the elongate support member that is pivotably connected to the frame and defines a seat for the first end of the headboard.

3. The headboard display rack according to claim 2, wherein each bracket assembly includes a first lateral support plate attached to the seat.

4. The headboard display rack according to claim 3, wherein the first lateral support plate includes an elongate slot formed therein.

5. The headboard display rack according to claim 3, wherein each roller assembly includes a footing for the second end of the headboard.

6. The headboard display rack according to claim 5, wherein each roller assembly includes a second lateral support plate attached to the footing.

7. The headboard display rack according to claim 2, wherein each bracket assembly includes an upper support member pivotably attached to the elongate support member.

8. The headboard display rack according to claim 7, wherein the upper support member includes a base plate pivotably attached to the elongate support member, and a pair of prongs extending from the base plate.

9. The headboard display rack according to claim 7, wherein the upper support member can be locked to the elongate support member via a handle.

10. A method for displaying a plurality of headboards, comprising attaching a plurality of headboards to a headboard display rack, wherein the step of attaching the plurality of headboards to the headboard display rack includes:

attaching a first end of the headboard to a bracket assembly that is pivotably attached to a frame by resting the first end on a seat of the bracket assembly, fixing the first end to the seat by fastening the first end to a first lateral support plate that extends from the seat, and securing the first end to the bracket assembly using an upper support member that includes a pair of prongs configured to contact and sandwich the first end therebetween; and attaching a second end of the headboard to a roller assembly that is separate and apart from the frame and bracket assembly by resting the second end on a footing of the roller assembly and fastening the second end to a second lateral support plate that extends from the foot.

11. The method of claim 10, wherein the securing the first end to the upper support member includes locating the first end between the prongs, and rotating the upper support member such that the prongs contact the first end.

12. The method of claim 11, further comprising locking the upper support member after rotating the upper support member to contact the prongs with the first end.

13. The method of claim 10, wherein the bracket assembly and roller assembly cooperate to pivot the headboard relative to the frame.

14. A headboard display rack for displaying a plurality of headboards, comprising:

a frame including an upper tubular member and a lower tubular member connected by a pair of side tubular members;

a pair of feet supporting the frame;

a plurality of bracket assemblies pivotably attached to the frame, each of the bracket assemblies including:

an elongate support member extending between the upper tubular member and the lower tubular member;

a first arm pivotably coupling the elongate support member to the upper tubular member;

a second arm pivotably coupling the elongate support member to the lower tubular member, the second arm defining a seat that is configured to support a first end of one of the headboards;

a first lateral support plate attached to and extending from the seat, and including an elongate slot for receipt of a fastener that secures the first end to the first lateral support plate; and an upper support member including a base plate pivotably attached to the elongate support member, and including a pair of prongs extending from the base plate; and a plurality of roller assemblies that correspond to each of the plurality of bracket assemblies, each roller assembly including a footing that is configured to support a second end of the one of the headboards with a caster attached thereto, and each roller assembly including a second lateral support plate attached to and extending from the footing, the second lateral support plate including another elongate slot for receipt of another fastener that secures the second end to the second lateral support plate.

15. The headboard display rack according to claim 14, wherein upper support member pivots relative to the elongate support member to contact each of the prongs with the first end of the headboard.

16. The headboard display rack according to claim 15, wherein the upper support member is configured to be locked relative to the elongate support member via a handle.

* * * * *